US007316049B1

(12) United States Patent
Robinson, Sr. et al.

(10) Patent No.: US 7,316,049 B1
(45) Date of Patent: Jan. 8, 2008

(54) APPARATUS AND METHOD FOR EVACUATING A LIQUID

(75) Inventors: Robert S. Robinson, Sr., Hamilton, OH (US); Robert G. Robinson, Jr., Hamilton, OH (US)

(73) Assignee: Kaivac, Inc., Hamilton, OH (US)

( * ) Notice: Subject to any disclaimer, the term of this patent is extended or adjusted under 35 U.S.C. 154(b) by 393 days.

(21) Appl. No.: 10/403,786

(22) Filed: Mar. 31, 2003

Related U.S. Application Data

(60) Provisional application No. 60/388,263, filed on Jun. 12, 2002.

(51) Int. Cl.
*A47L 5/36* (2006.01)
*A47L 7/00* (2006.01)

(52) U.S. Cl. ..... 15/327.2; 15/327.6; 15/353; 417/40

(58) Field of Classification Search ..... 15/327.1, 15/327.2, 327.6, 353; 417/40
See application file for complete search history.

(56) References Cited

U.S. PATENT DOCUMENTS 2,791,964 A * 5/1957 Reeve ..... 417/40
4,080,104 A * 3/1978 Brown, Jr. ..... 417/17
4,112,538 A * 9/1978 Bates ..... 15/321
4,246,676 A * 1/1981 Hallsworth et al. ..... 15/353
4,723,971 A * 2/1988 Caldas ..... 96/385
4,823,428 A * 4/1989 Sevigny ..... 15/302
5,263,225 A * 11/1993 Winters ..... 15/353
5,465,455 A * 11/1995 Allen ..... 15/319
5,918,344 A * 7/1999 Crevling et al. ..... 15/339
2002/0152578 A1* 10/2002 Lee ..... 15/353

FOREIGN PATENT DOCUMENTS

WO WO 94/01035 * 1/1994

* cited by examiner

*Primary Examiner*—Theresa T. Snider
(74) *Attorney, Agent, or Firm*—David E. Pritchard

(57) ABSTRACT

One version of the portable liquid-evacuation device may include: a container having a top wall, a bottom wall, a sidewall, a liquid inlet, a liquid outlet, and an air outlet, with the air outlet being connectable to a remote vacuum source; a pump positioned in the container, with the pump including a pump outlet; and a conduit extending from the pump outlet to the liquid outlet. In this particular version, the device may be free of both an integral vacuum source and a float-activated liquid-inlet closure. In another version, the device may include: a top wall including a liquid outlet; a pump attached to the top wall, with the pump including a pump inlet and a pump outlet; and a conduit extending from the pump outlet to the liquid outlet. In this version, the device may be free of a container sidewall and a container bottom wall.

17 Claims, 1 Drawing Sheet

APPARATUS AND METHOD FOR EVACUATING A LIQUID

CROSS-REFERENCE TO RELATED PATENT DOCUMENT

This patent document claims the benefit of the filing date of U.S. Provisional Application No. 60/388,263 entitled "Portable Sump Pump" and filed on Jun. 12, 2002. The entire disclosure of the '263 application is incorporated into this patent document by reference.

BACKGROUND OF THE INVENTION

1. Field of the Invention

This invention relates to transporting liquids, and more particularly, to devices and methods for evacuating liquids.

2. Description of the Related Art

At various, often unpredictable, times, liquids undesirably accumulate in a given location, for any of a number of different reasons. Regardless of the reason, typically there is a strong desire, if not an absolute need, to remove such liquids from the given location, typically as quickly and efficiently as possible.

For example, a homeowner may have to deal with a flooded basement or pools of standing water in a yard, after a heavy rain or overflowing of a river. In an industrial setting, a worker may encounter a large spill of a chemical solution, which, if not quickly removed, may pose a risk to the safety of the worker and their colleagues. If a water pipe bursts, for example in a residential-, commercial-, or industrial-structure, hundreds, if not thousands, of gallons of water may flood the particular building in a relatively short period of time. Also, in the case of a structural fire, the given structure may be flooded with thousands of gallons of water, in the process of putting out the fire.

Thankfully, a given homeowner, building-maintenance worker, or disaster-recovery worker typically is not faced with these kinds of situations on a daily basis. However, when such a situation does occur, a person needs to remove the liquid immediately. Failure to do so often results in serious (additional) damage to the particular structure or grounds involved, and dramatically increases the possibility for injury and illness to people in or around the particular site. Examples of risks to people include electrical shock, slipping and falling, and exposure to mold, bacteria, and other pathogens.

In an effort to address this situation, people have invented wet/dry vacuum cleaners, as well as wet/dry vacuum cleaners with built-in pumps. Because of the wet/dry vacuum cleaner's relative portability and relatively low purchase-cost, many building-maintenance services, and even homeowners, own such devices. However, when large quantities of liquid need to be moved quickly, these users find such vacuums to be relatively ineffective. For example, such devices have an extremely limited capacity. Therefore, when the vacuum cleaner's liquid-reservoir has filled, the user must remove the device from the site, empty the liquid, and bring the vacuum cleaner back to the site. Because of this "batch process", liquid removal is relatively slow, resulting in significant damage to the particular flood site and heightened risk to people at the site.

As mentioned briefly above, inventors also have created, at least conceptually, three wet/dry vacuums which house a liquid pump. These inventions are described in Brown, Jr. U.S. Pat. No. 4,080,104, Chayer U.S. Pat. No. 5,349,722, and Allen U.S. Pat. No. 5,465,455. However, as shown and described, these devices are quite cumbersome, being both large and heavy. Also, based on the descriptions provided in these patents, the purchase-price for these devices would be quite high. Given the low probability of frequent flood-recovery situations at a single site, most building-maintenance services and property owners would be unwilling to pay to have such a device on the premises—particularly when one or more relatively mobile, low-cost, conventional wet/dry vacuum cleaners already are "on site".

The end-result is that, although many building-maintenance workers and property owners have a tool which may be effective in a minor liquid-evacuation situation, these workers and owners are poorly equipped for any significant flood-recovery or liquid evacuation.

SUMMARY OF THE INVENTION

The invention overcomes the limitations discussed above by providing a portable liquid-evacuation device which is connectable to a vacuum source, such as, for example, a conventional wet/dry vacuum cleaner—thereby enabling a user not only to "take on" a significant liquid-evacuation situation, but also to do so in a continuous-operation process. The liquid-evacuation device also is compact, lightweight, low-cost, and high in throughput-capacity—thereby making the device an ideal choice for facility-maintenance services and property owners.

In one aspect, the portable liquid-evacuation device includes: a container having a top wall, a bottom wall, a sidewall, a liquid inlet, a liquid outlet, and an air outlet, with the air outlet being connectable to a remote vacuum source; a pump positioned in the container, with the pump including a pump outlet; and a conduit extending from the pump outlet to the liquid outlet. In this particular version, the portable liquid-moving device may be free of both an integral vacuum-source and a float-activated liquid-inlet closure.

In another aspect, the top wall may be releasably connectable with the sidewall. If desired, the top wall may include a groove, and the sidewall may include an upper rim, with the groove adapted to form a releasable seal with the upper rim. In addition, the groove may be annular. If desired, the container, itself, may have a liquid-capacity in the range of from about three gallons to about five gallons.

In a further aspect, the device may include reinforcing structure in contact with the sidewall of the container. The sidewall, itself, includes an interior surface, and the reinforcing structure may contact this interior surface. If desired, the reinforcing structure may include a band or strip of reinforcing material. Also, the band or strip may have an annular configuration. If used, the reinforcing structure adds strength to the container sidewall, which may be advantageous depending on the strength of the vacuum being provided by the remote vacuum source.

In yet another aspect, the device may include reinforcing structure in contact with the bottom wall of the container. The bottom wall includes an interior surface, and the reinforcing structure may contact this interior surface. If desired, the reinforcing structure may include, or be in the form of, a layer of reinforcing material.

In an additional aspect, the pump may be constructed and arranged so as to contact, simultaneously, both the top wall and the bottom wall of the container, thereby further strengthening the portable liquid-evacuation device. If a layer or sheet of reinforcing material (e.g., a plastic disk) is positioned on the interior surface of the bottom wall, then the pump may contact the bottom wall indirectly, with the reinforcing material making direct contact with the pump.

When the words "contact" and "contacting" are used in this patent document, they encompass both direct contact(ing) and indirect contact(ing), unless expressly stated otherwise. If desired, the pump may include a float and a float-activated switch. In this fashion, the pump may be turned on and off automatically, based on the level of a liquid in the container. In addition, the top wall of the container includes an interior surface, and, if desired, the pump may be mounted to this interior surface.

A further aspect of the invention is directed to a liquid-transport system, with the system including a portable liquid-evacuation device according to the principles of the invention, in combination with a remote vacuum source.

In another aspect, the portable liquid-evacuation device includes: a top wall including a liquid outlet; a pump attached to the top wall, the pump including a pump inlet and a pump outlet; and a conduit extending from the pump outlet to the liquid outlet. In this particular version, the portable liquid-evacuating device may be free of both a container sidewall and a container bottom wall. Given the absence of a container, liquid from a flood site may enter directly into the pump via the pump inlet, without first passing through a liquid inlet of a container, and into an interior reservoir or space define by such a container.

In a further aspect, the pump may include a bottom portion, and the pump inlet may be located at the bottom portion. An additional aspect of the invention is directed to a liquid-transport system, with the system including a portable liquid-evacuation device of the invention, in combination with a liquid-discharge hose, with the liquid-discharge hose being connectable with the liquid outlet.

A method of evacuating a liquid, in accordance with the principles of the invention, may include the steps of: activating a remote vacuum-source, with the remote vacuum-source being connected to a portable liquid-evacuating device of the invention; drawing a liquid through the device's container-liquid-inlet into an interior space defined by the container; and pumping at least a portion of the liquid from the interior space through the device's container-liquid-outlet. The pumping step may include pumping at least a portion of the liquid to a remote location. The remote location may be any suitable location, with non-limiting examples including a remote area of ground, a sink, or a toilet.

In yet another version, the method of evacuating a liquid may include the steps of: activating a portable liquid-evacuating device of the invention; drawing a liquid into the device's pump via the pump inlet; and pumping at least a portion of the liquid from the device's pump via the pump outlet, through the device's conduit, and through the device's liquid outlet. The pumping step may include pumping at least a portion of the liquid to a remote location. In addition, with the liquid-evacuating device in combination with a liquid-discharge hose, the liquid-discharge hose may be connected to the liquid outlet, and the pumping step may include pumping at least a portion of the liquid through the liquid-discharge hose.

BRIEF DESCRIPTION OF THE DRAWINGS

The accompanying drawings, which are incorporated into, and constitute a part of, this specification, illustrate versions of the invention and, together with the general description of the invention given above, and the detailed description of versions of the invention given below, serve to explain the principles of the invention.

DETAILED DESCRIPTION OF THE DRAWINGS

Figure 1:
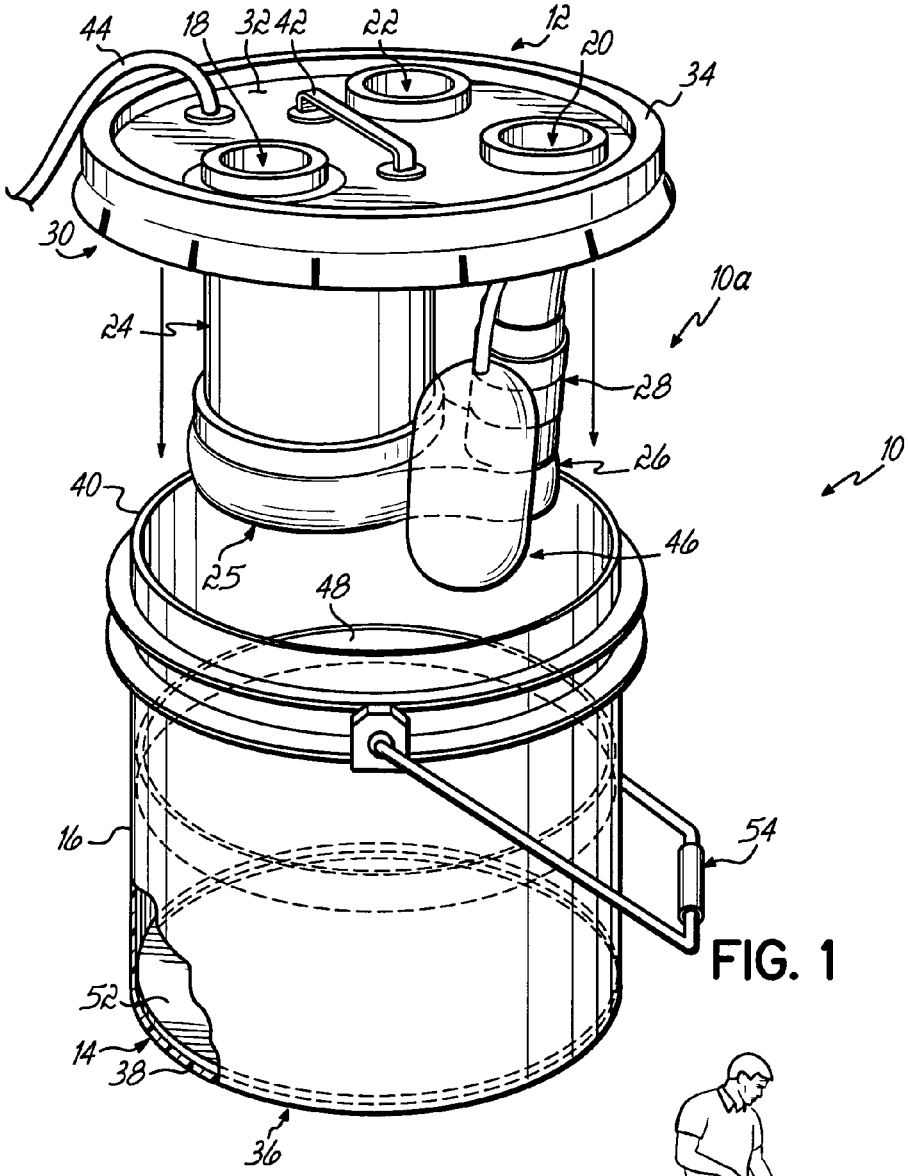
FIG. 1 is a schematic perspective view of a version of the liquid-evacuation device, in accordance with the principles of the invention, with the device being shown in a partially-disassembled state.

The portable liquid-evacuation device 10 shown in FIG. 1 includes: a container having a top wall 12, a bottom wall 14, a sidewall 16, a liquid inlet 18, a liquid outlet 20, and an air outlet 22, with the air outlet 22 being connectable to a remote vacuum source (not shown); a pump 24 positioned in the container, with the pump 24 including a pump outlet 26; and a conduit 28 extending from the pump outlet 26 to the liquid outlet 20. In this particular version, the top wall 12 is circular in shape, and includes an interior surface 30, an oppositely-disposed exterior surface 32, and a circumferential flange 34 extending downward. An annular groove (not shown) is formed in the flange 34, along the interior surface 30 of the top wall 12. The top wall 12 also includes the liquid inlet 18, the liquid outlet 20, and the air outlet 22, with each of the outlets 18, 20, 22 extending through the top wall 12.

The sidewall 16 of the container has a cross-sectional shape which is circular, with the sidewall 16 being integrally formed with the bottom wall 14 of the container. The bottom wall 14, itself, is circular in shape, and has both an exterior surface 36 and an oppositely-disposed interior surface 38. The sidewall further includes an upper rim 40 at the top of the sidewall 16, with the upper rim 40 corresponding with the annular groove in the flange 34 of the top wall 12. In this fashion, a user may releasably connect the top wall 12 to the sidewall 16, with a portion of the upper rim 40 fitting into the annular groove.

The pump 24 is connected directly to the interior surface 30 of the top wall 12. More specifically, screws (not shown) connect a handle 42 to the exterior surface 32 of the top wall 12, with the screws extending through the top wall 12, into threaded bores (not shown) positioned in the top of the pump 24, thereby securing the pump 24 to the interior surface 30 of the top wall 12. The pump 24, itself, includes a power cord 44, a liquid inlet (not shown), a liquid outlet 26, a float 46, and a float-activated switch (not shown). The float 46 is particularly beneficial, in that it serves to turn the pump 24 on and off automatically, based on the level of a liquid in the container. The conduit 28 has an inner end and an outer end, with the inner end being connected to the pump outlet 26, and the outer end being connected to the liquid outlet 20. In addition, the conduit 28 includes a one-way check valve (not shown) thereby preventing water which has been pumped through and out of the pump 24 from moving back into the pump 24. The power cord 44 extends upward through an opening in the top wall 12, and is connectable to a suitable power source (not shown).

The sidewall 16 further includes reinforcing structure in the form of an annular band or strip 48, with the band 48 resting on and/or biased against the interior surface 50 of the sidewall 16, approximately half-way up the sidewall 16. The annular band 48 serves to reinforce the container sidewall 16, which may be particularly helpful depending on the strength of the vacuum being provided by a remote vacuum source (not shown). The container includes additional reinforcing structure in the form of a circular layer or disk 52. This layer or disk 52 also may be beneficial, depending upon the particular strength of the vacuum being pulled by a remote vacuum source (not shown). The container sidewall 16 also has a handle 54 which is pivotably connected to the sidewall 16. In this fashion, a user easily may pick up the sidewall/bottom wall portion 14,16 of the container with one hand.

Figure 2:
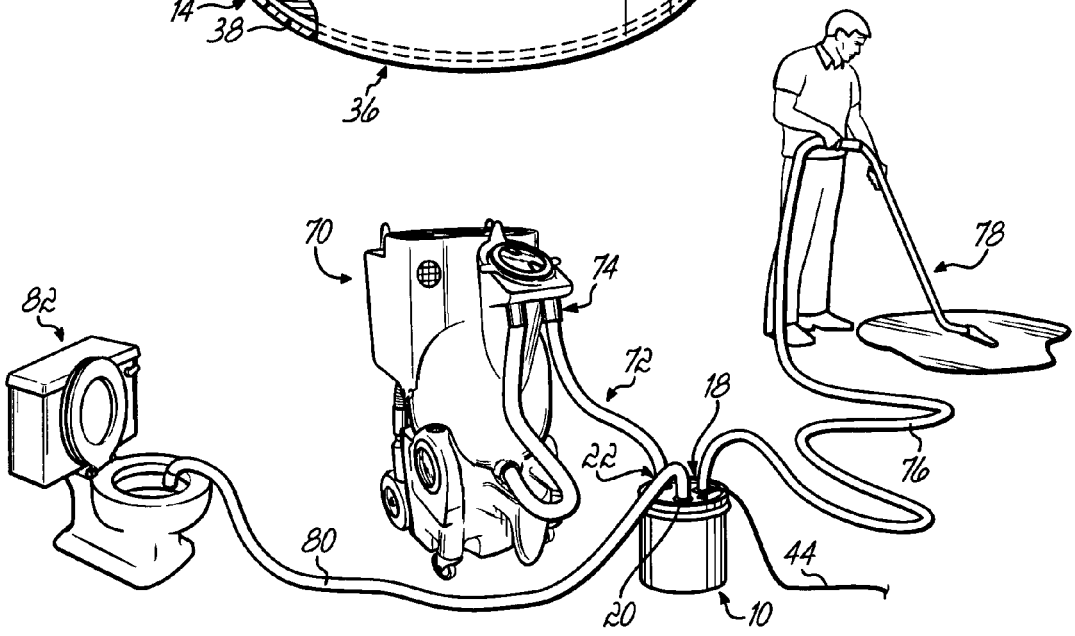
FIG. 2 is a schematic perspective view of a liquid-evacuation device substantially as shown in FIG. 1, being used in combination with other elements, to evacuate a liquid from a flood site to a receptacle.

In use, and with reference to FIGS. 1 and 2, the top wall 12 of the container is releasably connected to the sidewall 16 of the container. If desired, the power cord 44 may be a conventional 120-volt power cord having a three-prong plug. Also, either the power cord 44, an extension cord (not shown) to which the power cord 44 is connected, or a wall outlet (not shown) may include a ground-fault circuit interrupter ("GFCI"). Given that the portable liquid-evacuation device 10 is used to evacuate liquid, the use of a GFCI enhances overall safety.

As described briefly above, the portable liquid-evacuation device 10 is connected to a remote vacuum source. The remote vacuum source may be any suitable vacuum source, with non-limiting examples including a conventional wet/dry vacuum cleaner, and any of the vacuum-containing multi-functional cleaning machines manufactured and sold by Kaivac, Inc. of Hamilton, Ohio. Examples of such machines include the KaiVac®-, KaiWhiz™-, and KaiZen™-multi-functional cleaning machines. The KaiVac® machine is described in U.S. Pat. No. 6,206,980, entitled "Multi-Functional Cleaning Machine" and issued on Mar. 27, 2001. The KaiWhiz™ machine is described in U.S. patent application No. 60/397,375 entitled "Ergonomic Cleaning Machine Vehicle" and filed on Jul. 19, 2002. The KaiZen™ machine is described in U.S. Patent Application No. 60/417,907 entitled "Floor Cleaning Machine with Spigot and Vacuum" and filed on Oct. 11, 2002. The entire disclosure of each of these three patent documents is incorporated into this patent document by reference. The particular remote vacuum source shown in FIG. 2 is the KaiZen™ multi-functional cleaning machine 70. As seen in FIG. 2, one end of a length of vac hose 72 is releasably connected to the air outlet 22 of the portable liquid evacuation device 10, and the other end of the vac hose 72 is releasably connected to the vac inlet 74 of the multi-functional cleaning machine 70. In addition, one end of a liquid intake hose 76 is releasably connected to the liquid inlet 18 of the top wall 12 of the device 10, and the other end of the liquid intake hose 76 is releasably connected to a wand/tool assembly 78. Also, one end of a liquid discharge hose 80 is releasably connected to the liquid outlet 20 of the top wall 12 of the device 10, with the other end of the liquid discharge hose 80 being securely, yet releasably, positioned in the bowl of a toilet 82. As noted above, the discharge end of the liquid discharge line 80 may be positioned at any desired location which is remote from the liquid being evacuated. For example, if the floor of a room has been flooded, and the room has a window leading to the exterior, a user may want to pass a portion of the liquid discharge hose through the window, with the discharge end of the hose securely, yet releasably, anchored at a storm drain, on an area of ground which drains away from the building, or the like. Once the user has connected the various hoses and power cords, the user turns the power source (or sources) on, and begins to evacuate liquid from the flood site. The liquid passes through the wand/tool assembly, and into the portable liquid-evacuation device, drawn by the vacuum being provided by the multi-functional cleaning machine. As the liquid begins to accumulate in the device, the float moves upward, thereby activating the pump. At this point, the pump begins to move liquid from the device, through the liquid discharge hose, and into the toilet bowl. Moreover, as long as sufficient quantities of liquid are being drawn into the liquid-evacuation device, the float is oriented in an activated position, thereby providing for a continuous pump-out operation. In this fashion, the portable liquid-evacuation device removes high volumes of water as rapidly as possible. Furthermore, in contrast to the use of a conventional wet/dry vacuum cleaner alone, with the liquid-evacuation device, the user does not need to interrupt their work to transport and empty a filled vacuum reservoir. Accordingly, the liquid-evacuation device saves critical time, reduces labor costs, minimizes damage at the particular flood site, and reduces the risk of injury or sickness to people which may be exposed to the site.

FIG. 1 also shows another version of the liquid-evacuation device 10*a*. As described briefly above in the Summary, the top wall/pump/conduit subassembly 12,24,28, in the absence of a container sidewall/bottom wall subassembly 14,16 is yet another version of the liquid-evacuation device 10*a*. The device 10*a* may be placed directly in a pool of liquid to be evacuated. In this fashion, when power to the device 10*a* is turned on, and the float 46 is in an activated position, liquid is pumped directly into the pump 24 via the pump inlet 25 at the bottom wall of the pump 24. The liquid then passes through the pump 24, and is pumped through the conduit 28 and out the liquid outlet 20 formed in the top wall 12. A liquid discharge hose, such as the liquid discharge hose 80 shown in FIG. 2, may be connected to the liquid outlet 20, thereby enabling a user to evacuate at least a portion of a liquid from the flood site, through the liquid discharge hose, to a remote location.

The portable liquid-evacuation device may be made as follows. Various holes may be formed in the top wall of the container, corresponding with the location for the handle, power cord, liquid inlet, liquid outlet, and air outlet. Once the openings for the inlets and outlet have been formed, a grommet may be installed in each of these openings, thereby reinforcing the strength of each opening. The conduit may be formed by connecting a check valve to a bushing, connecting a length of PVC pipe to the check valve, and connecting a coupler to the PVC pipe. The bushing then may be connected to the pump outlet, and the coupler may be connected to the grommet which forms a part of the liquid outlet. In addition, at this time, the pump may be mounted to the top wall by screwing the handle to the top wall, with the screws extending into the threaded bores of the pump. The power cord which is connected to the pump may be passed through the opening in the top wall which was formed for passage of the power cord. A push-in connector may be secured about the power cord, and the push-in connector may be attached to the top wall. Also, caulk may be applied to the top wall and push-in connector, in order to further enhance the seal which is formed about the power cord. Once these items have been assembled, the top wall of the container may be releasably connected to the container sidewall. At this point, the portable liquid-evacuation device is ready for use.

The various components of the liquid-evacuation device may be any suitable components, and may be made of any suitable material or combination of materials. Advantageously, the materials should be non-corrosive in nature. If desired, the sidewall/bottom wall assembly may be a 3.5 gallon pail available from Cincinnati Container of Cincinnati, Ohio as part no. 22703. The top wall may be a corresponding pail lid from Cincinnati Container, identified as part no. 22715TT. If desired, the pump may be a model no. M53-D pump available from Ferguson Bath & Kitchen of Cincinnati, Ohio. The check valve may be a model no.

FP0026-6D check valve available from Sta-Rite of Delavan, Wis. The discharge hose may be a model no. FP0012-6F hose, also available from Sta-Rite. If desired, the vac hose may be a model no. 15NBK040-1 hose available from United Electric of Burlington, N.C. When the liquid-evacuation device is made as described above, and combined with a vacuum source such as the KaiZen™ multi-functional cleaning machine, the device may pump liquid from a flood/spill surface to a location which may be as much as about thirty feet higher than the flood/spill surface. This capability is especially beneficial, in that it allows a user to evacuate a liquid to an elevated, remote discharge location, such as, for example, from a flooded basement, through a window, to a remote area of ground.

While the present invention has been illustrated by a description of various versions, and while the illustrative versions have been described in considerable detail, it is not the intention of the inventors to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of the inventors' general inventive concept.

What is claimed is:

1. A portable liquid-evacuation device, comprising:

a container including a top wall, a bottom wall, and a sidewall, the container further including a liquid inlet, a liquid outlet, and an air outlet, the air outlet being connectable to a remote vacuum source;

a pump positioned in the container, the pump including a pump outlet; and a conduit extending from the pump outlet to the liquid outlet, the portable liquid-evacuation device being free of each of an integral vacuum-source, a float-activated liquid-inlet closure, and an air-outlet closure.

2. The device of claim 1 wherein the top wall is releasably connectable with the sidewall.

3. The device of claim 2 wherein the top wall includes a groove, and the sidewall includes an upper rim, the groove adapted to form a releasable seal with the upper rim.

4. The device of claim 1 wherein the container has a liquid-capacity in the range of from about three gallons to about five gallons.

5. The device of claim 1 further including reinforcing structure in contact with the sidewall.

6. The device of claim 5 wherein the sidewall includes an interior surface, and the reinforcing structure contacts the interior surface.

7. The device of claim 6 wherein the reinforcing structure includes a band of reinforcing material.

8. The device of claim 1 further including reinforcing structure in contact with the bottom wall.

9. The device of claim 8 wherein the bottom wall includes an interior surface, and the reinforcing structure contacts the interior surface.

10. The device of claim 9 wherein the reinforcing structure includes a layer of reinforcing material.

11. The device of claim 1 wherein the pump is constructed and arranged so as to contact simultaneously both the top wall and the bottom wall, thereby further strengthening the device.

12. The device of claim 1 wherein the pump includes a float and a float-activated switch, whereby the pump may be turned on and off automatically, based on the level of a liquid in the container.

13. The device of claim 1 wherein the top wall includes a lower surface, and the pump is mounted to the lower surface.

14. The device of claim 1 in combination with a remote vacuum source.

15. A method of evacuating a liquid, comprising the steps of:

activating a remote vacuum source, the remote vacuum source connected to a portable liquid-evacuating device, the portable liquid-evacuating device comprising:

a container including a top wall, a bottom wall, and a sidewall, the container further including a liquid inlet, a liquid outlet, and an air outlet, the air outlet connected to the remote vacuum source;

a pump positioned in the container, the pump including a pump outlet; and a conduit extending from the pump outlet to the liquid outlet, the portable liquid-evacuating device being free of each of an integral vacuum-source, a float-activated liquid-inlet closure, and an air-outlet closure;

drawing a liquid through the liquid inlet into an interior space defined by the container; and pumping at least a portion of the liquid from the interior space through the liquid outlet.

16. The method of claim 15 wherein the pumping step includes pumping at least a portion of the liquid to a remote location.

17. The method of claim 16 wherein the remote location is a toilet.

* * * * *